US009545654B2

(12) United States Patent
Yoshida

(10) Patent No.: US 9,545,654 B2
(45) Date of Patent: Jan. 17, 2017

(54) PRESS BRAKE AND BENDING METHOD USING PRESS BRAKE

(75) Inventor: Hidehiko Yoshida, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 513 days.

(21) Appl. No.: 14/124,042

(22) PCT Filed: Jun. 4, 2012

(86) PCT No.: PCT/JP2012/064390

§ 371 (c)(1),
(2), (4) Date: Dec. 5, 2013

(87) PCT Pub. No.: WO2012/169461

PCT Pub. Date: Dec. 13, 2012

(65) Prior Publication Data

US 2014/0123723 A1 May 8, 2014

(30) Foreign Application Priority Data

Jun. 6, 2011 (JP) ..... 2011-126058

(51) Int. Cl.
*B21D 5/00* (2006.01)
*B21D 5/02* (2006.01)

(52) U.S. Cl.
CPC ..... *B21D 5/02* (2013.01); *B21D 5/004* (2013.01); *B21D 5/006* (2013.01); *B21D 5/0254* (2013.01)

(58) Field of Classification Search
CPC ..... B21D 5/02; B21D 5/004; B21D 5/006; B21D 5/0254
See application file for complete search history.

(56) References Cited

FOREIGN PATENT DOCUMENTS

| | | |
|---|---|---|
| EP | 0 470 263 | 2/1992 |
| EP | 1 844 870 | 10/2007 |
| JP | 02-030326 | 1/1990 |
| JP | 9-201623 | 8/1997 |
| JP | 10-286627 | 10/1998 |
| JP | 2000-071028 | 3/2000 |
| JP | 2004-337950 | 12/2004 |
| WO | 00/41824 | 7/2000 |

OTHER PUBLICATIONS

International Search Report, mail date is Aug. 21, 2012.
Search report from E.P.O., mail date is Feb. 11, 2015.

*Primary Examiner* — Teresa M Ekiert
(74) *Attorney, Agent, or Firm* — Greenblum & Bernstein, P.L.C.

(57) ABSTRACT

A press brake includes a first guide rail on one side, a second guide rail on another side, an ATC device and a first measurement portion movable on the first guide rail, and a second measurement portion movable on the second guide rail. The first and second measurement portions measure a bent angle of a workpiece. The second guide rail is different from the first guide rail in their cross-sectional shapes. The first measurement portion includes a main unit having a sensor, and a first coupling portion coupling the main unit with the first guide rail. The second measurement portion includes the main unit, and a second coupling portion different from the first coupling portion coupling the main unit with the second guide rail. The ATC device and the measurement portions can be made coexistent and the main units of the measurement portions can be made identical to each other.

6 Claims, 14 Drawing Sheets

PRESS BRAKE AND BENDING METHOD USING PRESS BRAKE

TECHNICAL FIELD

The present invention relates to a press brake and a bending method using a press brake. Especially, the present invention relates to a press brake that includes an automatic tool changer (ATC device) and a bent angle measurement device, and a bending method using the press brake.

BACKGROUND ART

A Patent Document 1 listed below discloses a press brake that includes guide rails extended along a longitudinal direction of a ram, and ATC devices movable on the guide rails. The ATC device for a top tool (punch) is provided behind the top tool, and the ATC device for a bottom tool (die) is provided behind the bottom tool.

A Patent Document 2 listed below discloses a press brake that includes guide rails extended along a longitudinal direction of a ram, a bent angle measurement device (also referred as a bend measurement device) that moves on the guide rails and measures a bent angle of a workpiece being worked. The bend measurement device is provided on the bottom tool (die) from a front side to a rear side with respect to the center of the bottom tool (die).

PRIOR ART DOCUMENT

Patent Document

Patent Document 1: PCT International Application Publication No. WO00/41824

Patent Document 2: Japanese Patent Application Laid-Open No. H02-030326

SUMMARY OF INVENTION

Trying to apply an ATC device and a bend measurement device as mentioned above to a press brake, it is difficult to make the ATC device and the bend measurement device coexistent because movable areas, located behind the die, of the ATC device and the bend measurement device are overlapped with each other.

In addition, since mass and dimension size of an ATC device are larger than those of a bend measurement device, a guide rail for supporting the bend measurement device may not be able to support the ATC device. Namely, in order to support an ATC device, required is a higher-strength, higher-rigidity and larger-size guide rail than a guide rail for supporting a bend measurement device.

Further, a bend measurement device can achieve high-accuracy measurements in a case where positions of its front and rear measurement portions are set equivalent with respect to the center of a die and the measurement portions (at least each includes a sensor) have an identical configuration to each other. However, it is difficult for the front and rear measurement portions to have an identical configuration, because the front and rear guide rails are different from each other.

Therefore, an object of the present invention is to provide a press brake that can make an ATC device and a bend measurement device coexistent and make front and rear measurement portions of the bend measurement device have an identical configuration, and a bending method using the press brake.

A first aspect of the present invention provides a press including an upper table to which a top tool is attachable and a lower table that is disposed oppositely to the upper table and to which a bottom tool is attachable within a predetermined lateral range to bend a workpiece by the top tool and the bottom tool, the press brake comprising: a first guide rail extended laterally on one of a front side or a rear side of the lower table; a second guide rail extended laterally on another of the front side or the rear side of the lower table; an ATC device movably supported by the first guide rail to exchange the bottom tool; a first measurement portion movably supported by the first guide rail to measure a shape (or dimension) of the one side of the workpiece; and a second measurement portion movably supported by the second guide rail to measure a shape of the other side of the workpiece, wherein the second guide rail has a different cross-sectional shape from a cross-sectional shape of the first guide rail, or is extended on the lower table at a bilaterally asymmetrical position to the first guide rail, the first measurement portion includes a first main unit having a sensor for measuring a shape of the workpiece, and a first coupling portion for coupling the first main unit with the first guide rail, and the second measurement portion includes a second main unit having an identical configuration to a configuration of the first main unit, and a second coupling portion having a different shape from a shape of the first coupling portion for coupling the second main unit with the second guide rail.

A second aspect of the present invention provides a bending method for the workpiece using the press brake according to the above first aspect that further comprises a controller that controls movements and operations of the first measurement portion and the ATC device on the first guide rail, the method comprising: controlling the first measurement portion by the controller to move the first measurement portion into the first waiting area; controlling the ATC device by the controller to install a bottom tool on the lower table within the predetermined lateral range; controlling the ATC device by the controller to move the ATC device into the second waiting area; and controlling the first measurement portion by the controller to measure a shape of the workpiece bent by the installed bottom tool by using the first measurement portion.

DESCRIPTION OF EMBODIMENTS

A press brake 1 according to an embodiment will be explained hereinafter with reference to FIG. 1 to FIG. 15.

(Configuration of Press Brake 1)

Figure 1:
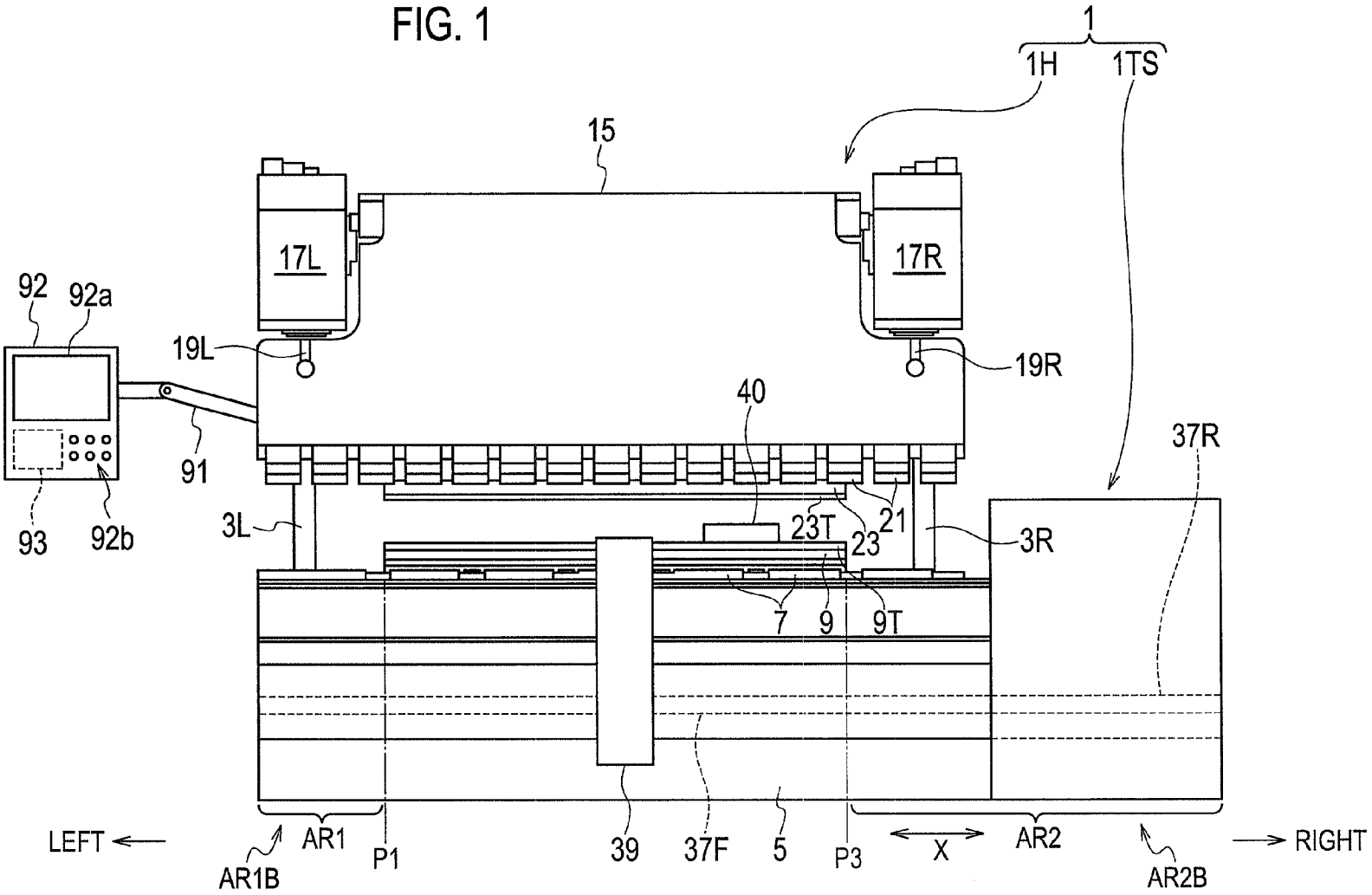
FIG. 1 It is a front view of a press brake according to an embodiment.

As shown in FIG. 1, the press brake 1 according to the present embodiment includes a press brake main body (hereinafter, simply referred as a main body) 1H, and a stacker 1TS provided on one side (right side in FIG. 1) along a lateral direction of the main body 1H. In the stacker 1TS, exchangeable tools to be exchanged by an after-explained ATC device 40 are stocked.

Figure 2:
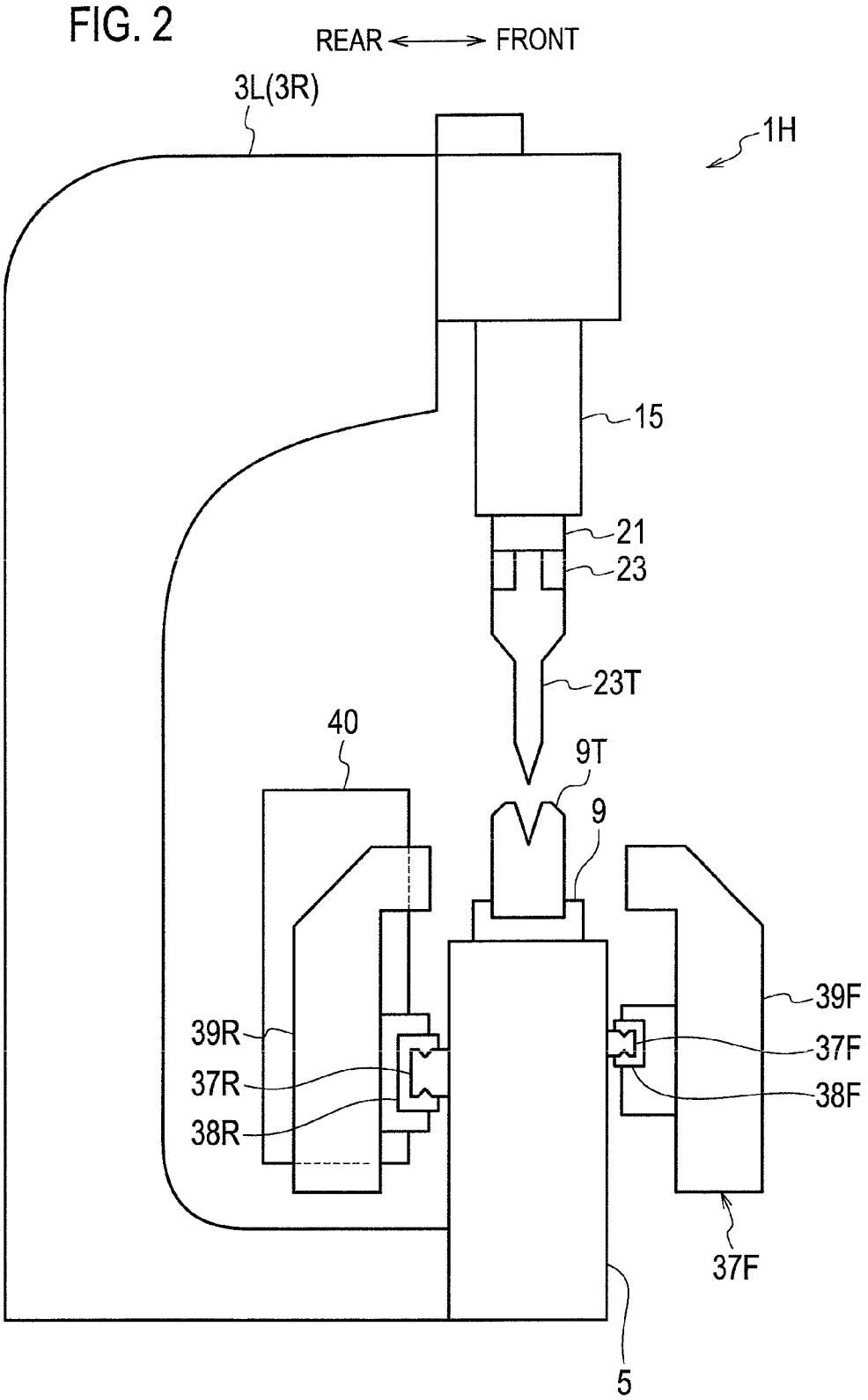
FIG. 2 It is a left side view of a press brake main body in the press brake.

As shown in FIG. 1 and FIG. 2, the main body 1H includes a pair of side frames 3L and 3R each has an almost C-shaped side view, and a base 5 with which their lower portions are fixed. Bottom tool holders 7 (see FIG. 1: not shown in FIG. 2) are provided on a front side (near side in FIG. 1) of the base 5. A die station (lower table) 9 is fixed with upper portions of the bottom tool holders 7. A bottom tool (die) 9T is detachably fixed with the die station 9.

On the other hand, a vertically movable ram 15 is provided at an upper portion of the pair of side frames 3L and 3R. Oil hydraulic cylinders (actuators) 17L and 17R are provided on upper both sides of the ram 15, respectively. Piston rods 19L and 19R are attached to lower portions of the oil hydraulic cylinders 17L and 17R, respectively. The ram 15 is supported by the oil hydraulic cylinders 17L and 17R with a ball bearing at each lower end of the piston rods 19L and 19R interposed therebetween.

When the oil hydraulic cylinders 17L and 17*r* are actuated, the ram 15 is vertically moved by the piston rods 19L and 19R. A punch station (upper table) is attached to a lower center of the ram 15 with top tool holders 21 interposed therebetween. A top tool (punch) 23T is detachably fixed with the punch station 23. An operation unit 92 has a display 92*a*, an operation panel 92*b* and a controller 93. Note that, of course, a touchscreen into which the display 92*a* and the operation panel 92*b* are integrated may be used.

A (second) guide rail 37F for linear movements of an after-explained (second) measurement portion 39F along a lateral direction (an X-axis direction) is provided on a front face of the base 5. A (first) guide rail 37R for linear movements of an after explained (first) measurement portion 39R and an after explained ATC device 40 along the lateral direction is provided on a rear face of the base 5. An end of the guide rail 37F on the front face is extended at least to an end (a position P3 in FIG. 1) of the die station 9, and to a right end of the base 5 in the present embodiment. Another end of the guide rail 37F on the front face is extended out to an area outer than another end (a position P1 in FIG. 1) of the die station 9.

An end of the guide rail 37R on the rear face is extended to the stacker ITS. Another end of the guide rail 37R on the rear face is extended out to the area outer than the other end (the position P1) of the die station 9. The area outer than the position P1 of the main body 1H is referred as a measurement portion waiting area AR1. In addition, a section of the main body 1H outer than the position P1 is referred as a measurement portion waiting section (first waiting section) AR1B. On the other hand, an area of the guide rail 37R outer than the position P3 is referred as an ATC device waiting area AR2. In addition, a section of the main body 1H outer than the position P3 is referred as an ATC device waiting section (second waiting section) AR2B. The stacker 1TS is included in the ATC device waiting section AR2B.

A (front) measurement portion 39F for measuring front dimension of a workpiece is slidably attached to the guide rail 37F. The measurement portion 39F has a block 38F, and is coupled with the guide rail 37F with the block 38F interposed therebetween. Similarly, a (rear) measurement portion 39R for measuring rear dimension of the workpiece is slidably attached to the guide rail 37R. The measurement portion 39R has a block 38R, and is coupled with the guide rail 37R with the block 38R interposed therebetween. For example, "LM guide" (trademark owned by THK Co., Ltd.) can be used as pairs of the guide rails 37F/37R and the blocks 38F/38R.

Figure 3:
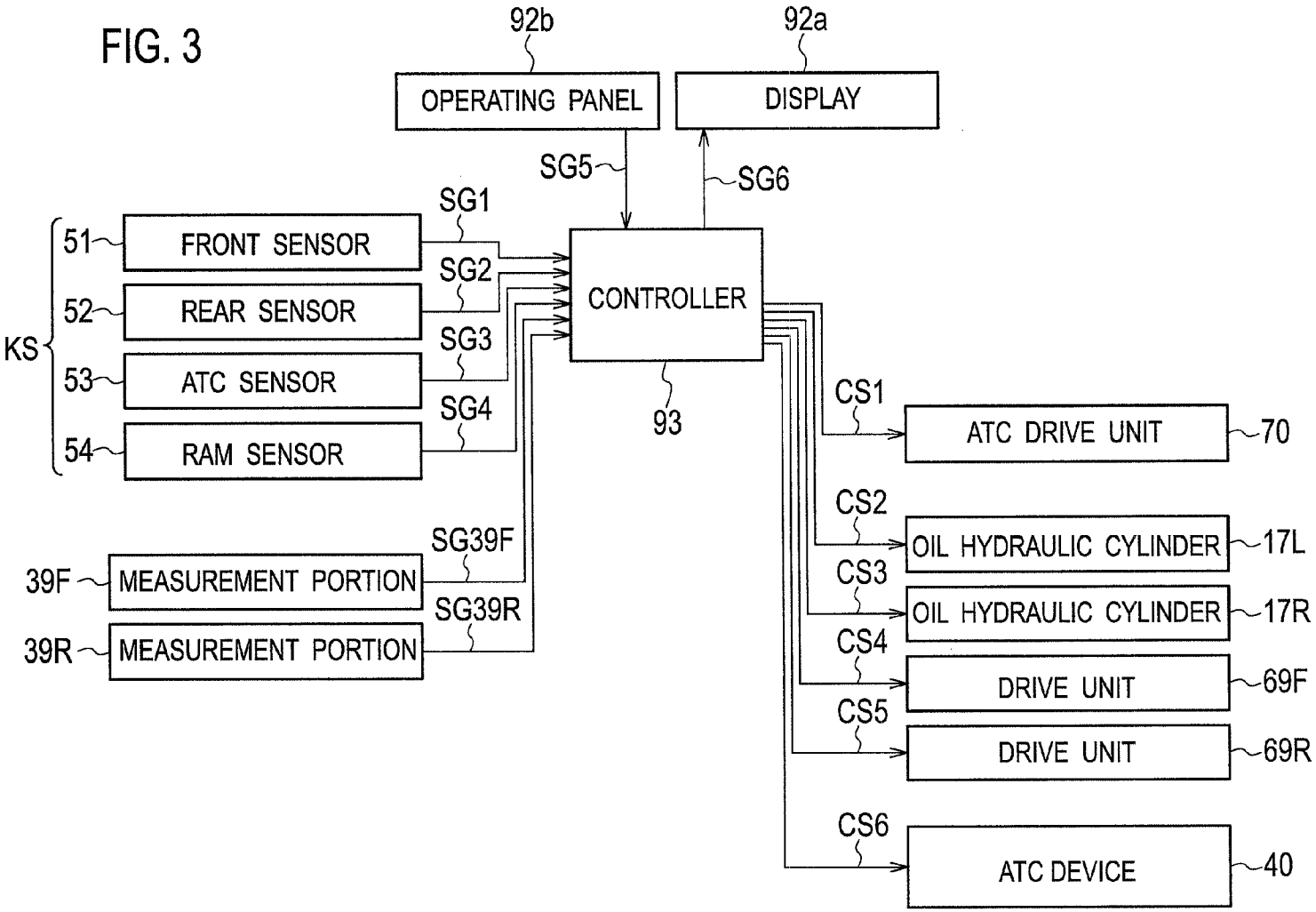
FIG. 3 It is a block diagram of the press brake.

As shown in FIG. 3, drive units 69F and 69R for driving the measurement portions 39F and 39R, respectively, are provided on the base 5. The drive units 69F and 69R move the measurement portions 39F and 39R along the guide rails 37F and 37R, respectively, based on commands from the controller 93. Generally, the controller 93 controls the measurement portions 39F and 39R to move the measurement portions 39F and 39R while facing them to each other. Namely, the measurement portions 39F and 39R can be moved synchronously with each other. Of course, the controller 93 can also control the measurement portions 39F and 39R to move the measurement portions 39F and 39R independently from each other.

An ATC device 4 for automatically exchanging the dies 9T is attached to the rear guide rail 37R slidably along the guide rail 37R in the lateral direction. As shown in FIG. 3, an ATC drive unit 70 (not shown in FIG. 1 and FIG. 2) for driving the ATC device 40 is provided on the base 5. The ATC drive unit 70 moves the ATC device 40 along the guide rail 37R based on commands from the controller 93.

Note that a guide rail (not shown) may be provided on a front or rear side of the punch station 23 and an ATC device (not shown) may be provided slidably on the guide rail. The ATC device 40 is attached to the guide rail 37R on a side of the stacker 1TS with respect to the measurement portion 39R. As explained above, only the measurement portion 39F is supported by the front guide rail 37F, and the measurement portion 39F and the ATC device are supported by the rear guide rail 37R.

As shown in FIG. 3, the press brake 1 includes a detection sensors KS. The detection sensors KS includes a front sensor 51 for detecting a position of the measurement portion 39F, a rear sensor 52 for detecting a position of the measurement portion 39R, an ATC sensor 53 for detecting a position of the ATC device 40, and a ram sensor 54 for detecting a position of the ram 15.

The front sensor 51 continuously detects a lateral position of the measurement portion 39F on the guide rail 37F, and outputs a signal SG1 to the controller 93 as front measurement portion position information. The rear sensor 52 continuously detects a lateral position of the measurement portion 39R on the guide rail 37R, and outputs a signal SG2 to the controller 93 as rear measurement portion position information. The ATC sensor 53 continuously detects a lateral position of the ATC device 40 on the guide rail 37R, and outputs a signal SG3 to the controller 93 as ATC position information. The ram sensor 54 continuously detects a vertical position of the ram 15 within a movable range of the ram 15, and outputs a signal SG4 to the controller 93 as ram position information.

The operation panel 92*b* outputs a signal SG5 to the controller 93 based on user's operations. The measurement portions 39F and 39R detect a bent shape of a workpiece, and outputs signals SG39F and SG39R to the controller 93 as measurement result information.

The controller 93 also controls operations of each of the drive units. The controller 93 outputs a control signal CS1 to the ATC drive unit 70 to control movements of the ATC device 40 on the guide rail 37R. The controller 93 outputs control signals CS2 and CS3 to the oil hydraulic cylinders 17L and 17R to control vertical movements of the ram 15. The controller 93 outputs a control signal CS4 to the drive unit 69F to control movements of the measurement portion 39F on the guide rail 37F. The controller 93 outputs a control signal CS5 to the drive unit 69R to control movements of the measurement portion 39R on the guide rail 37R. The controller 93 outputs a control signal CS6 to the ATC device 40 to control exchanges of tools by the ATC device 40.

In addition, the controller 93 outputs a graphic signal SG6 to the display 92*a* to control graphical displays (including movies) on the display 92*a*. The graphical displays include operational information of the press brake 1 and input information from the operation panel 92*b*, for example.

(Operations of Press Brake 1)

Operations of the press brake 1 are done as shown by following 1) to 5).

1) Based on bending processes of a workpiece, the ATC device 40 selects an adequate die 9T from the stacker 1ST, and carries it to the die station 9 to install it at an adequate place.

2) After installation of the die 9T, the ATC device 40 is moved to the ATC device waiting area AR2 (e.g. in the stacker 1ST), and, instead, the measurement portion 39R is moved from the measurement portion waiting area AR1 to a position (workpiece measurement position) of the installed die 9T.

3) The ram 15 is moved downward to start a bending of a workpiece. Shape changes of the workpiece is continuously measured by the measurement portions 39F and 39R, and then the downward movement of the ram 15 is stopped when a desired bent angle determined in consideration of springback is achieved. The ram 15 is held for a given time if necessary, and then moved upward.

4) Orientation of the workpiece is changed for a next process, and then the operations are started again from the process of the above 3).

5) If a tool exchange is required during the operations, the measurement portion 39R is moved to the measurement portion waiting area AR1, and then the operations are started again from the process of the above 1).

Figure 4:
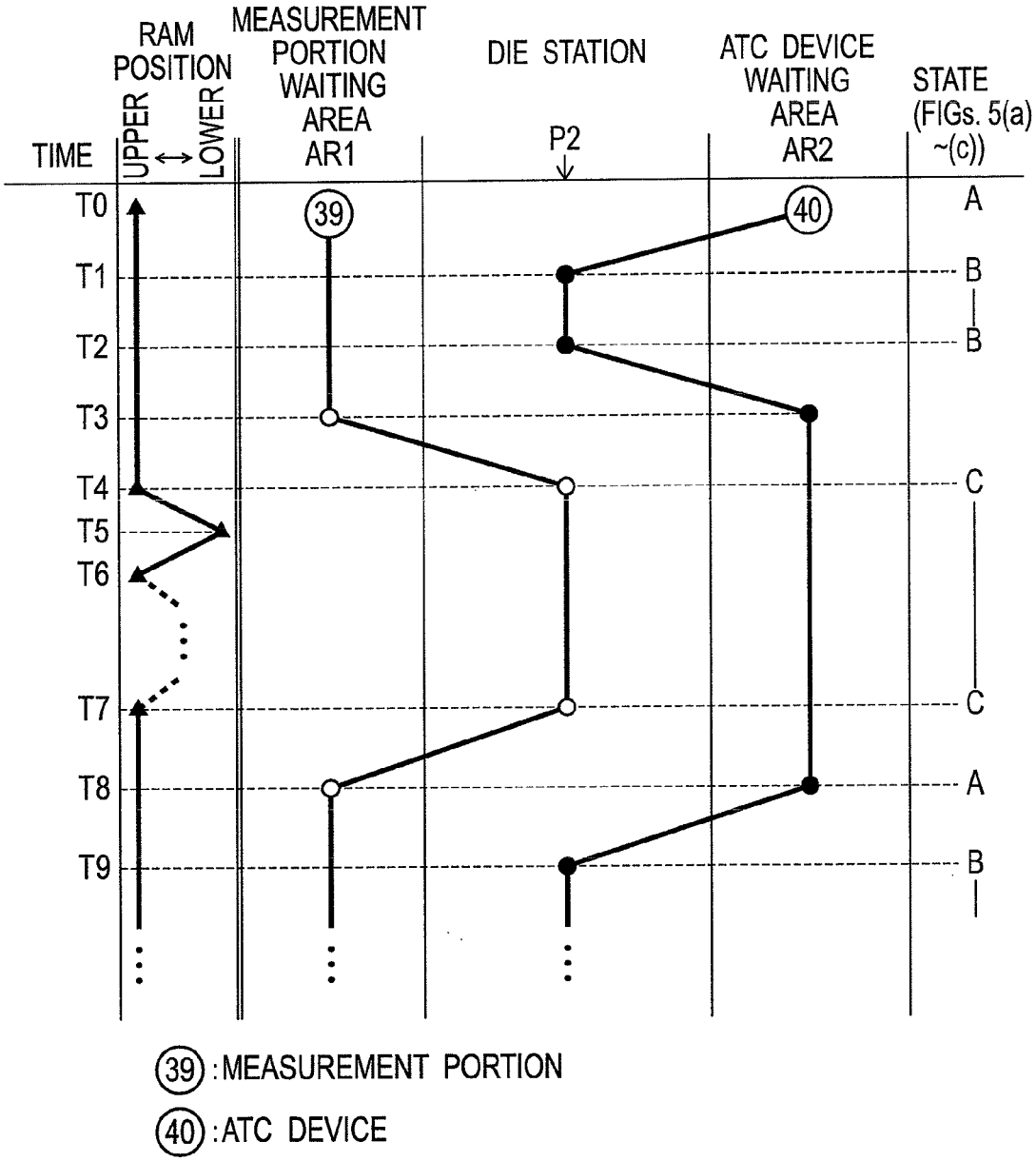
FIG. 4 It is a timing chart of the press brake.
Figure 5:
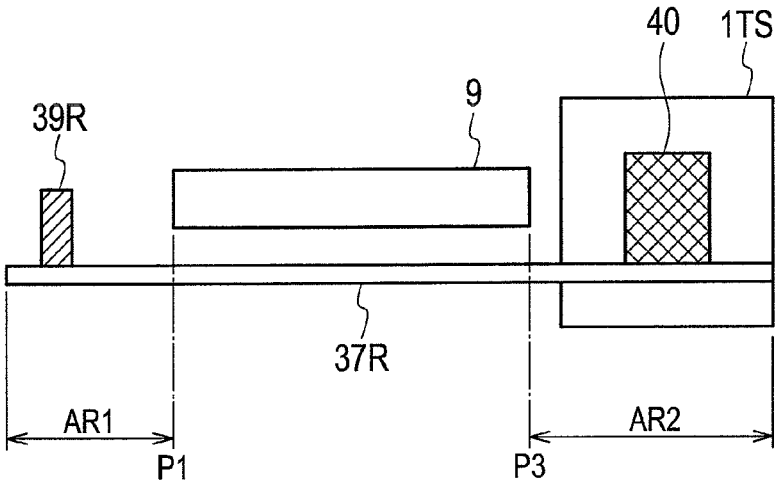
FIGS. 5(*a*) to 5(*c*) They are diagrams for explaining operations of the press brake.
Figure 5:
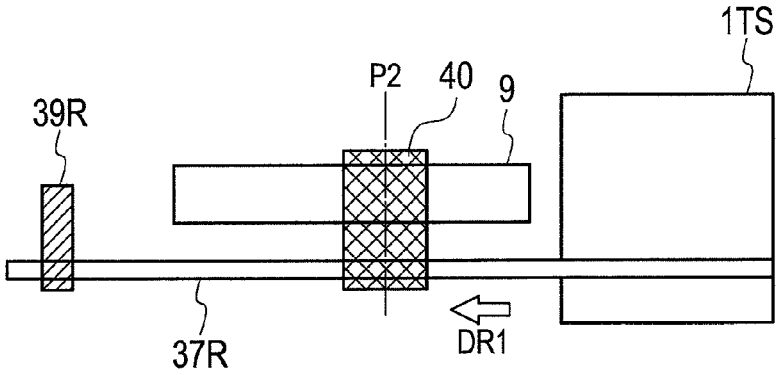
Figure 5:
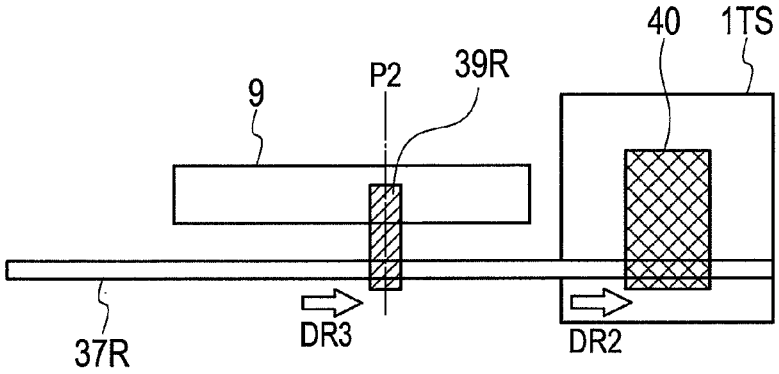

The above processes will be explained with reference to FIG. 4 and FIG. 5(*a*) to FIG. 5(*c*). Note that, in FIG. 4, movements of the measurement portions 39R and 39F moved synchronously are indicated by white circles, and movements of the ATC device 40 are indicated by black circles. In Fig. 5(*a*) to Fig. 5(*c*), the measurement portions 39F and 39R moved synchronously are shown by only the measurement portion 39R. In addition, Fig. 5(*a*) to Fig. 5(*c*) are views of the press brake 1 viewed from its front side, but show the rear guide rail 37R to make comparisons with FIG. 1 and FIG. 4 easy.

In following explanations of time T0 to T9, the drive unit 69F, the front sensor 51, the signal SG1, the measurement portion 39F and the signal SG39F that are associated with the measurement portion 39F moved synchronously with the measurement portion 39R will be indicated by using ( ). In addition, each time T1 to T9 in the following explanations and FIG. 4 indicates a time point when each duration time T1 to T9 elapses from the time T0, respectively.

A state of the press brake 1 at the time T0 is a base state (state A), and shown in FIG. 5(*a*). In the base state (state A), the measurement portion 39R (39F) is positioned in the measurement portion waiting area AR1, and the ATC device 40 is positioned in the ATC device waiting area AR2 (e.g. in the stacker 1ST).

[Time T0 to T1]

When a user inputs, to the operation panel 92*b*, a command for installing a desired tool at the position P2 on the die station 9, the controller 93 outputs, to the ATC device 40 and the ATC drive unit 70, a command DR1 for picking up the desired tool from the stacker 1ST and then moving to the position P2. The ATC device 40 is moved from the stacker 1TS to the position P2 by the ATC drive unit 70 based on the command DR1. The controller 93 judges whether or not the ATC device 40 reaches the position P2 based on the signal SG3 from the ATC sensor 53.

[Time T1 to T2]

When the controller 93 determines that the ATC device 40 reaches the position P2, it outputs, to the ATC device 40, a command for installing the tool carried to the position P2. The ACT device 40 installs the tool based on the command. A state from time T1 to T2 (state B) is shown in FIG. 5(*b*).

[Time T2 to T3]

When the controller 93 received, from the ATC device 40, a signal indicating installation completion of the tool, it outputs, to the ATC drive unit 70, a command DR2 for making the ATC device 40 waited in the stacker 1ST (ATC device waiting area AR2) again. The ATC device 40 is moved to the stacker 1ST by the ATC drive unit 70 to be in a waited state based on the command DR2.

[Time T3 to T4]

When the controller 93 determines that the ACT device 40 reaches the stacker 1ST based on the signal SG3 from the ATC sensor 53, it outputs a command DR3, to the drive unit 69R (69F), for moving the measurement portion 39R (39F) from the measurement portion waiting area AR1 to the position P2. The measurement portion 39R (39F) is moved to the position P2 by the drive unit 69R (69F) based on the command DR3. The controller 93 judges whether or not the measurement portion 39R (39F) reaches the position P2 based on the signal SG2 (SG1) from the rear sensor 52 (the front sensor 51).

[Time T4 to T5]

When the controller 93 determines that the measurement portion 39R (39F) reaches the position P2, it confirms that a workpiece is placed at an adequate position and then outputs a command for moving the ram 15 downward to the oil hydraulic cylinders 17L and 17R. The placement confirmation of the workpiece is automatically done by using a sensor, or done by a user's input from the operation panel 92*b* to the controller 93. The ram 15 is moved downward based on the move-downward command. The controller 93 calculates a bent angle of the workpiece based on the signals SG39F and SG39R from the measurement portions 39F and 39R, and judges whether or not the workpiece is bent to a desired bent angle. A method for calculating a bent angle will be explained later. In this judgment, parameters specific to material such as a springback amount and bending rigidity are taken into consideration.

[Time T5 to T6]

When the controller 93 determines that the workpiece is bent to the desired bent angle, it stops the downward movement of the ram 15 and holds the ram 15 for a given time if necessary, and then outputs a command for moving the ram 15 upward to the oil hydraulic cylinders 17L and 17R. The ram 15 is moved upward based on the command. A state from time T4 to T6 (state C) is shown in FIG. 5(*c*).

[Time T6 to T7]

In a case where plural workpiece are bent under an identical condition, bending operations of the above-explained time T4 to T6 are repeated. Here, the press brake 1 is in the state C.

[Time T7 to T8]

When bendings are completed the desired number of times and another bending(s) will be done at a position Px (not shown) other than the position P2, the controller 93 outputs, to the drive unit 69R (69F), a command for moving the measurement portion 39R (39F) to the measurement portion waiting area AR1. The measurement portion 39R (39F) is moved to the measurement portion waiting area AR1 by the drive unit 69R (69F) based on the command. The controller 93 judges whether or not the measurement portion 39R (39F) reaches the measurement portion waiting area AR1 based on the signal SG2 (SG1) from the rear sensor 52 (the front sensor 51).

[Time T8 to T9]

When the controller 93 determines that the measurement portion 39R (39F) reaches the measurement portion waiting area AR1 based on the signal SG2 (SG1), the controller 93 outputs, to the ATC device 40 and the ATC drive unit 70, a command for picking up another tool from the stacker 1ST and then moving to the position Px. The ATC device 40 is moved from the stacker 1TS to the position Px by the ATC drive unit 70 based on the command. Hereinafter, operations equivalent to those at-and-after the time T1 are made. Operations until the time T9 are shown in FIG. 4.

Note that the movement of the ATC device 40 from the time T2 to T3 and the movement of the measurement portion 39R (39F) from the time T3 to T4 can be made concurrently or partially overlapped so long as the both are not contacted with each other. Similar operations can be applied to the movement of the measurement portion 39R (39F) from the time T7 to T8 and the movement of the ATC device 40 from the time T8 to T9.

(Measurement Portions 39F and 39R)

Subsequently, the measurement portions 39F and 39R as a bend measurement device will be explained in detail with reference to FIG. 6 to FIG. 15. The measurement portions 39F and 39R continuously or intermittently measure bend states of a front side and a rear side of a workpiece during a bending process of the workpiece, respectively, and then output them to the controller 93.

Figure 6:
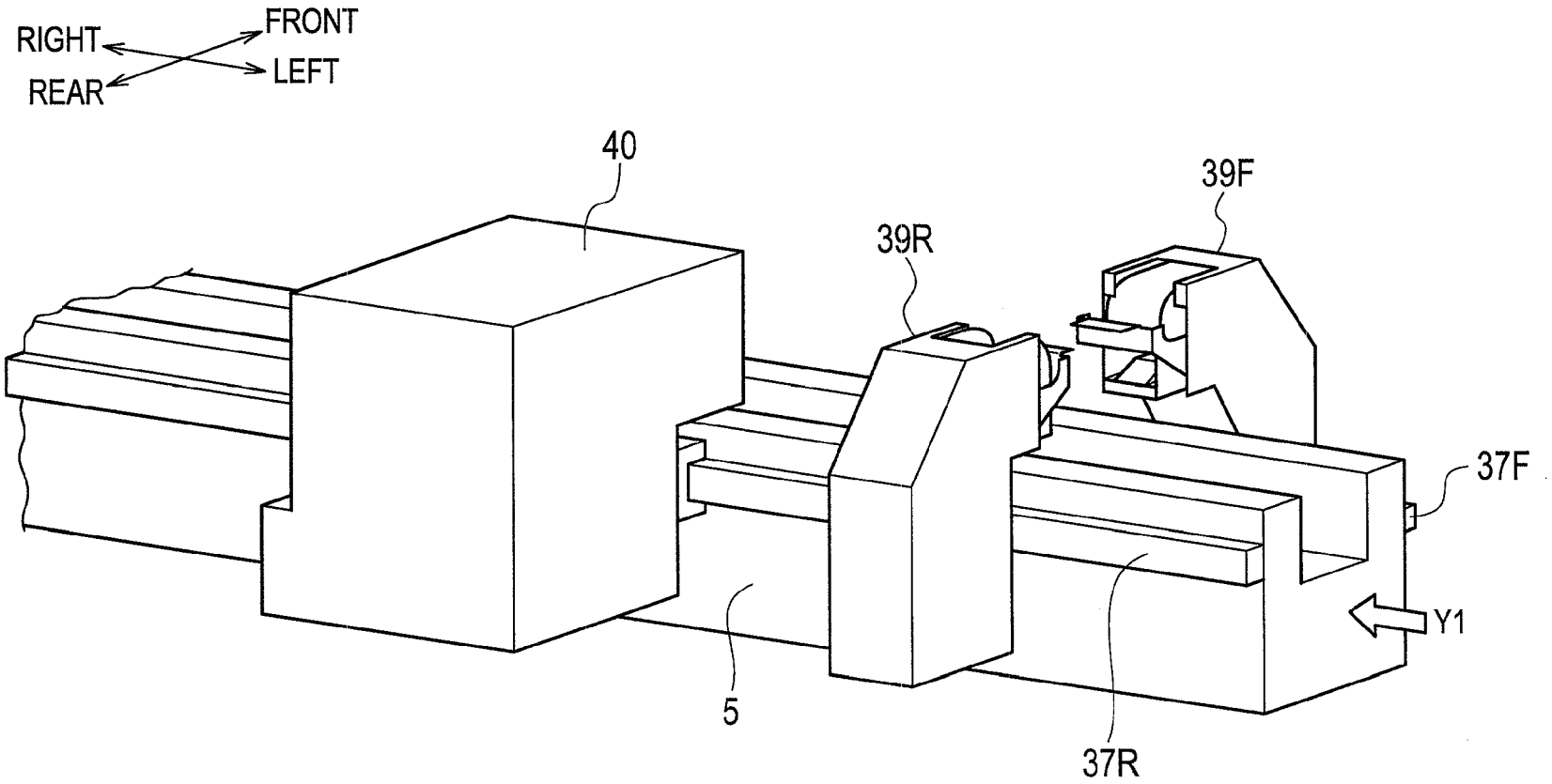
FIG. 6 It is a partial perspective view of the press brake.
Figure 7:
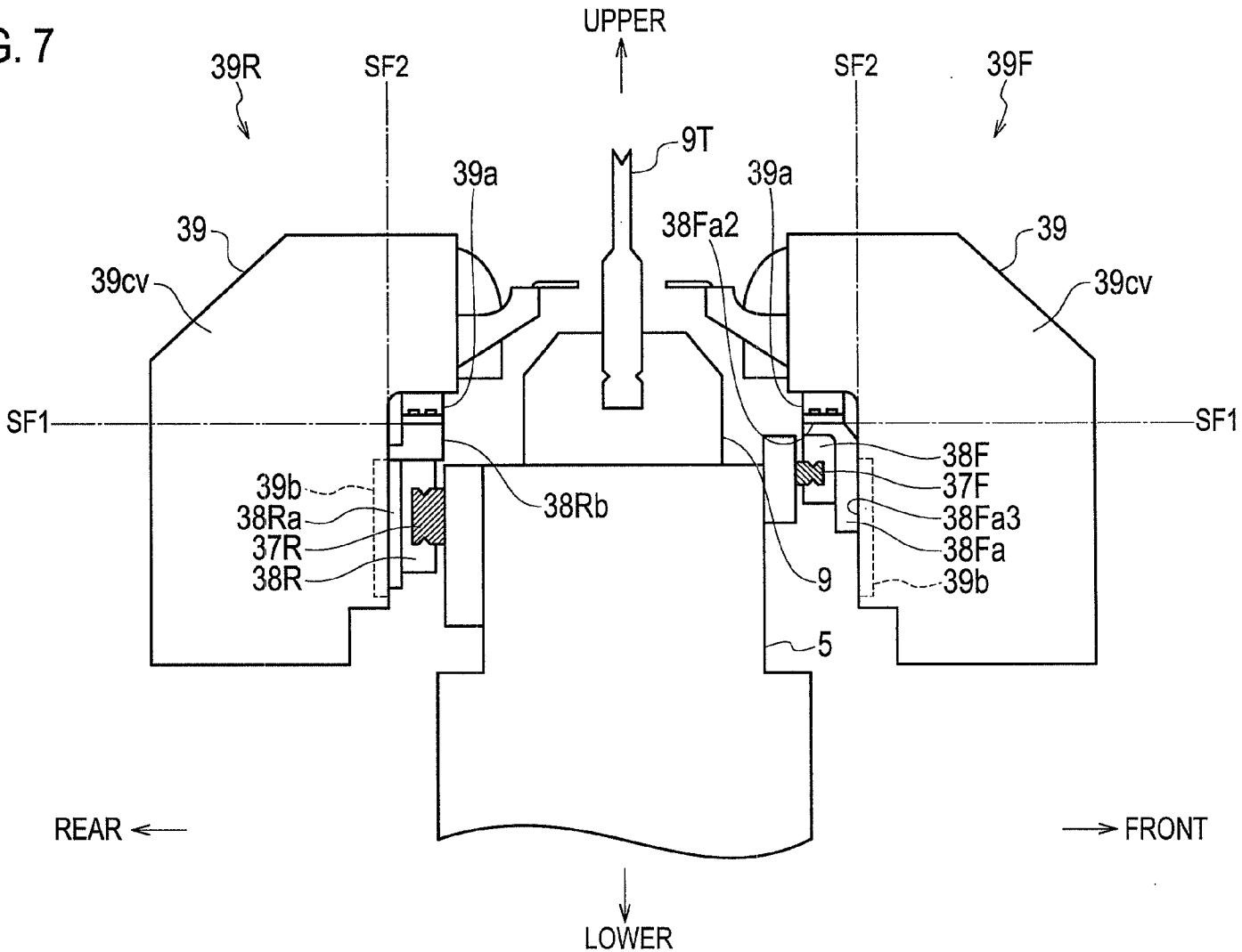
FIG. 7 It is a partial side view of the press brake.

FIG. 6 is a perspective view of the press brake 1 viewed from its rear left side, and shows the measurement portions 39F and 39R supported by the guide rails 37F and 37R and the ATC device 40 supported by the guide rail 37R. In FIG. 6, front, rear, left and right directions identical to those in FIG. 1 are shown. FIG. 7 is a side view viewed along an arrow Y1 in FIG. 6, and shows components not schematically but realistically. FIG. 7 shows a state where the die 9T is installed on the die station 9, and the ATC device 40 is not shown in it.

As shown in FIG. 6, the guide rail 37R supports the measurement portion 39R and the ATC device 40 whose mass is too much larger than that of the measurement portions 39R. Therefore, the guide rail 37R has a cross-sectional area larger than a cross-sectional area of the guide rail 37F, higher-rigidity, and higher-strength, so that it is configured so as to support both of the measurement portion 39R and the ATC device 40 with no problem. In addition, as shown in FIG. 7, the guide rail 37F and the guide rail 37R (indicated by hatching in FIG. 7) are attached at different height levels from each other.

In the present embodiment, the measurement portion 39F and the measurement portion 39R are attached to the guide rails 37F and 37R that have different shapes and different attached positions from each other by differently-shaped coupling members, respectively. Therefore, the measurement portion 39F and the measurement portion 39R can have (first/second) main units 39 that have an identical configuration.

Figure 8:
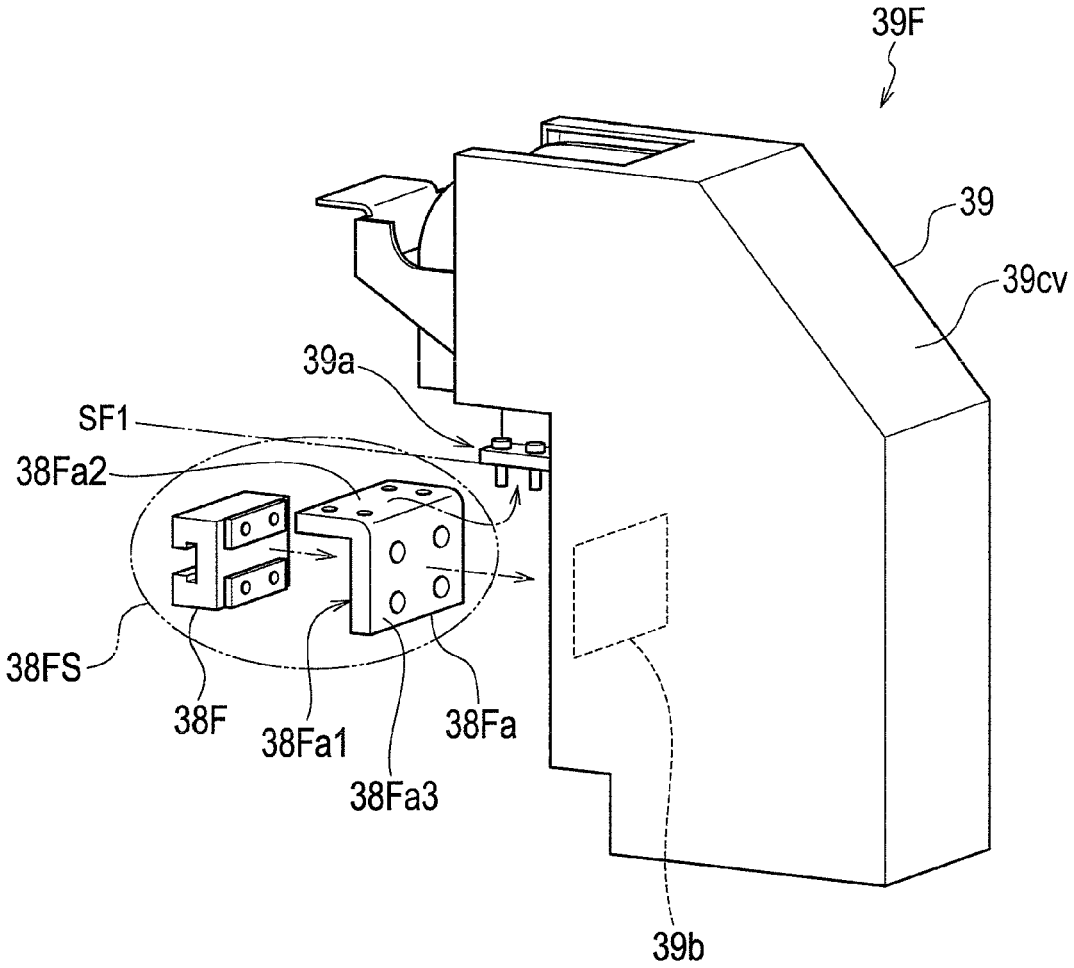
FIG. 8 It is a perspective view of a front part of measurement portions of the press brake.
Figure 9:
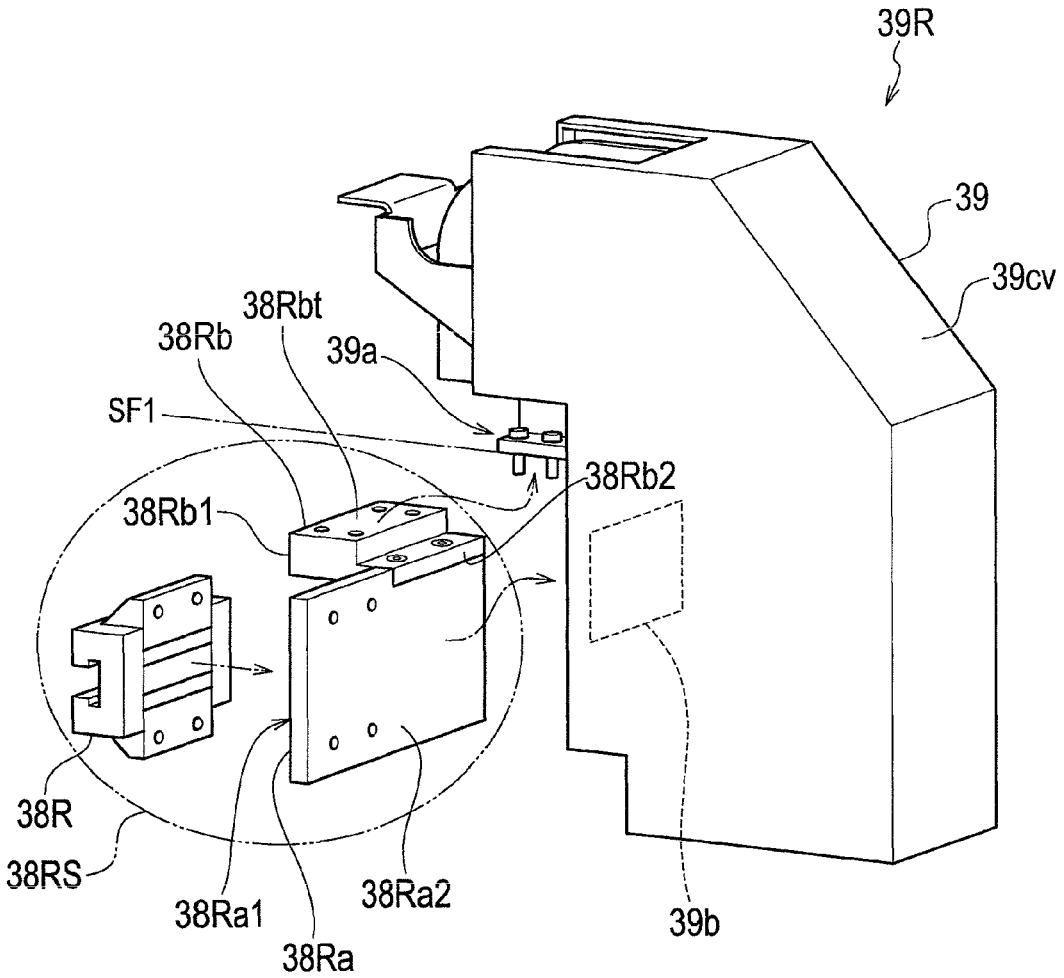
FIG. 9 It is a perspective view of a rear part of the measurement portions.

FIG. 8 shows the front measurement portion 39F, and FIG. 9 shows the rear measurement portion 39R. The measurement portion 39F is configured of the main unit 39 and a coupling portion 38FS, and the measurement portion 39R is configured of the main unit 39 and a coupling portion 38RS. Namely, the main units 39 of the measurement portion 39F and the measurement portion 39R have an identical configuration, and the coupling portion 38FS and the coupling portion 38RS have different configurations from each other.

As shown in FIG. 8 and FIG. 9, the main unit 39 has a protect cover 39*cv*, a first fixing portion 39*a* that is an attachment reference along a vertical direction, and a second fixing portion 39*b* that is an attachment reference along a front-rear direction. A position at a bottom face of the first fixing portion 39*a* becomes a reference position SF1 along a vertical direction (also see FIG. 7), and a position at a side face of the second fixing portion 39*b* becomes a reference position SF2 along a front-rear direction (see FIG. 7).

As shown in FIG. 7 and FIG. 8, the coupling portion 38FS of the front measurement portion 39F is configured to have a block 38F coupled with the guide rail 37F and an L-shaped bracket 38Fa. The block 38F is fixed with one side face 38Fa1 of the L-shaped bracket 38Fa. A top face 38Fa2 of the L-shaped bracket 38Fa is fixed with the first fixing portion 39*a* of the main unit 39. Another side face 38Fa3 of the L-shaped bracket 38Fa is fixed with the second fixing portion 39*b* of the main unit 39. The above components are fixed by screws or bolts, for example.

As shown in FIG. 7 and FIG. 9, the coupling portion 38RS of the rear measurement portion 39R is configured to have a block 38R coupled with the guide rail 37R, a flat plate 38Ra and a spacer 38Rb. In addition, the spacer 38Rb is configured of a cuboid portion 38Rb1 and a flange 38Rb2 monolithically extended from the cuboid portion 38Rb1. The block 38R is fixed with one face 38Ra1 of the plate 38Ra. A top face 38Rbt of the spacer 38Rb is fixed with the first fixing portion 39*a* of the main unit 39. Another face 38Ra2 of the plate 38Ra is fixed with the second fixing portion 39*b* of the main unit 39. The above components are fixed by screws or bolts, for example.

As shown in FIG. 7 to FIG. 9, the guide rail 37F and the guide rail 37R have different shapes from each other, and are attached to the base 5 at asymmetrical positions. However, shapes and dimensions of the coupling portions 38FS and 38RS are configured so that the first fixing portions 39*a* and the second fixing portions 39*b* of the measurement portions 39F and 39R are made coincident with the reference positions SF1 and SF2 shown in FIG. 7. Therefore, the measurement portions 39F and 39R can commonly use the main units 39 having an identical configuration.

Figure 10:
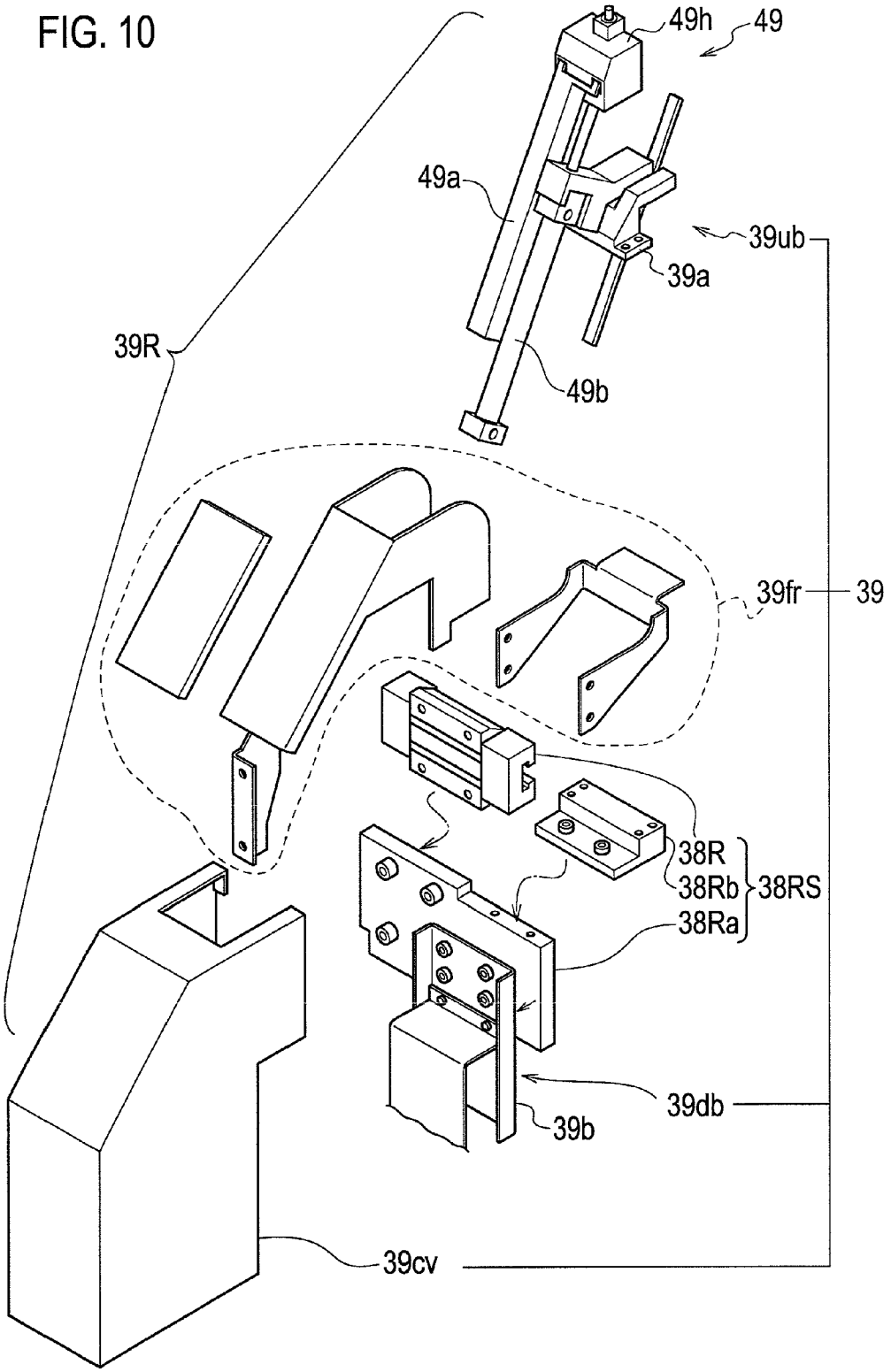
FIG. 10 It is an exploded perspective view of the rear part.
Figure 11:
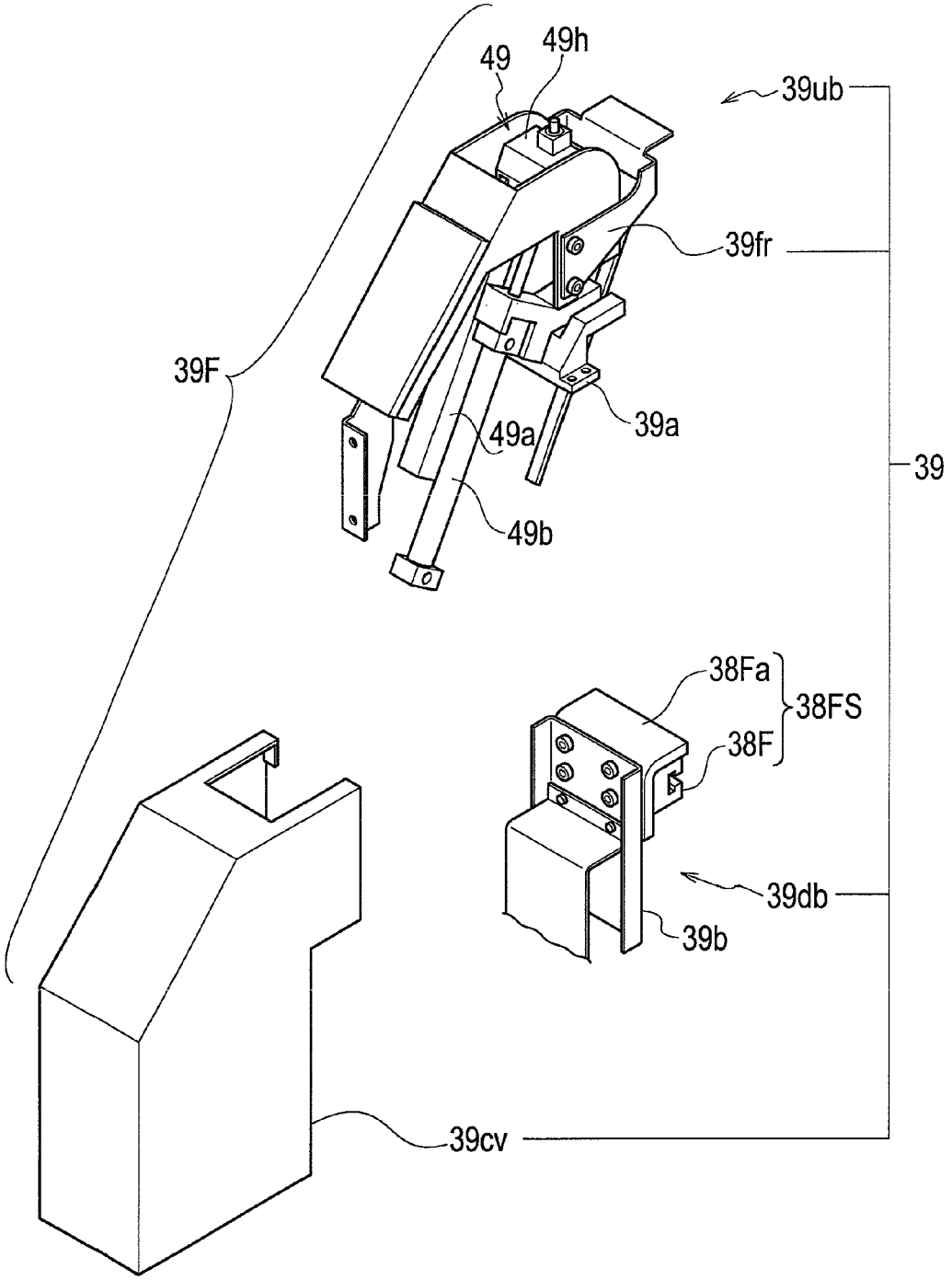
FIG. 11 It is an exploded perspective view of the front part.

The measurement portions 39F and 39R don't directly measure a bent angle of a workpiece, but measures a shape of workpiece required for calculation of a bent angle by the controller 93. FIG. 10 shows the rear measurement portion 39R and FIG. 11 shows the front measurement portion 39F, and each of the main units 39 includes an upper base 39*ub* including the first fixing portion 39*a*, a lower base 39*db* including the second fixing portion 39*b*, and the protect cover 39*cv* for covering the upper base 39*ub* and the lower base 39*db*.

The upper base 39*ub* and the lower base 39*db* are coupled with each other by a metal part(s) such as a frame 39*fr*. In addition, a sensor assembly 49 is attached to the upper base 39*ub*. The sensor assembly 49 has a sensor head 49*h*, an arm 49*a*, and an air cylinder 49*b*. The sensor head 49*h* is fixed with an end of the arm 49*a*. The air cylinder 49*b* extends and retracts a rod 49*r* (see FIG. 12). An end of the rod 49*r* is fixed with the sensor head 49*h* (and with the arm 49*a* with the sensor head 49 49*h* interposed therebetween). The air cylinder 49*b* moves the sensor head 49*h* by extending and retracting the rod 49*r*.

Figure 12:
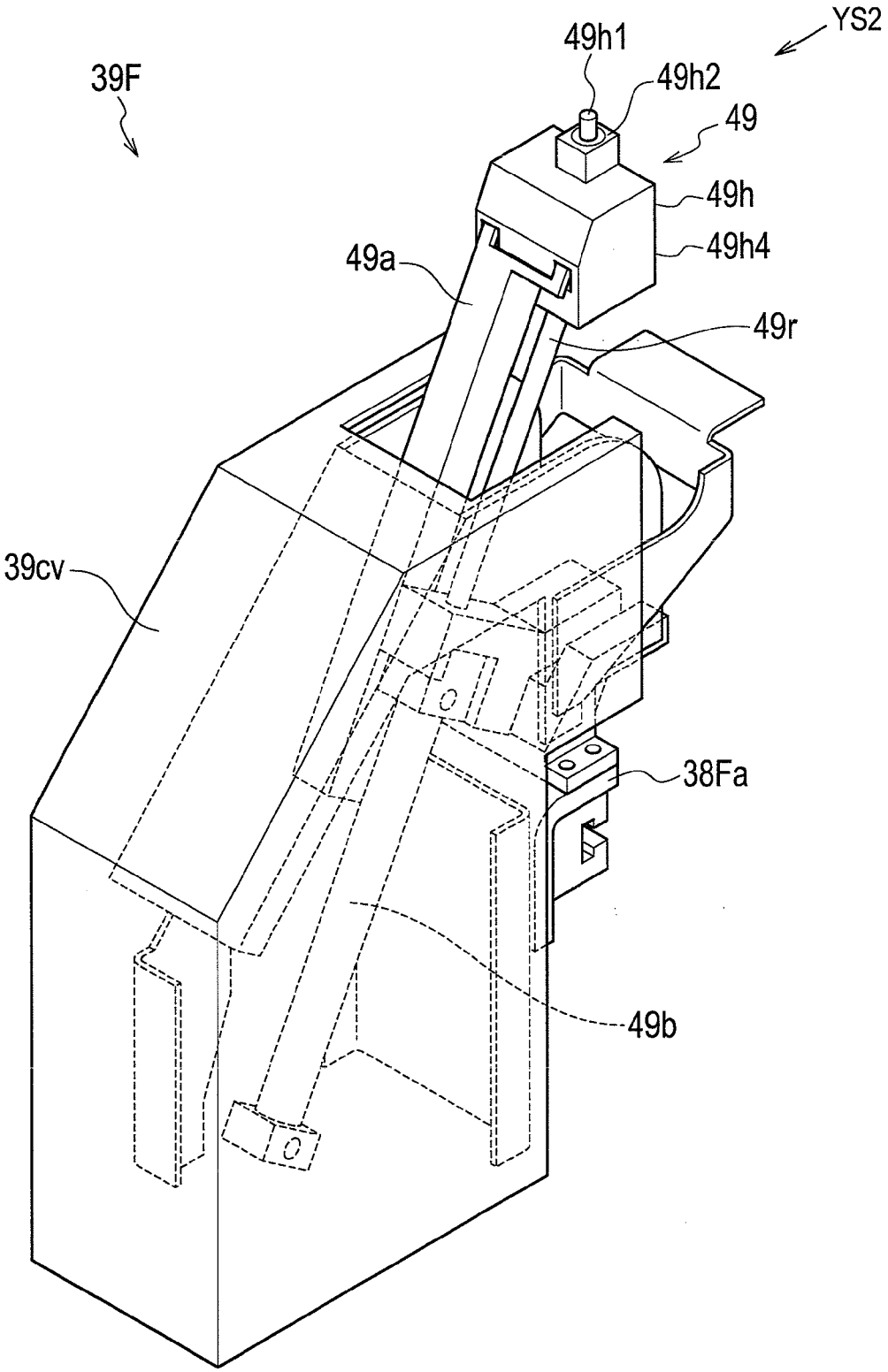
FIG. 12 It is a perspective view of the front part (when its sensor head is extended).

In a state where the measurement potions 39F and 39R are installed on the press brake 1, an operational direction of the air cylinder 49*b* (the rod 49*r*) is set oblique to a vertical direction. Namely, the sensor head 49*h* and the arm 49*a* are moved, by the air cylinder 49*b*, linearly and obliquely to a vertical plane including the reference position SF2 (see FIG. 7) of the second fixing portion 39*b*. FIG. 12 shows a state where the rod 49*r* is fully extended. On the other hand, in a state where the rod 49*r* is fully retracted, most port of the sensor head 49*h* is stored in an inside of the protect cover 39*cv* (see FIG. 7).

Figure 13:
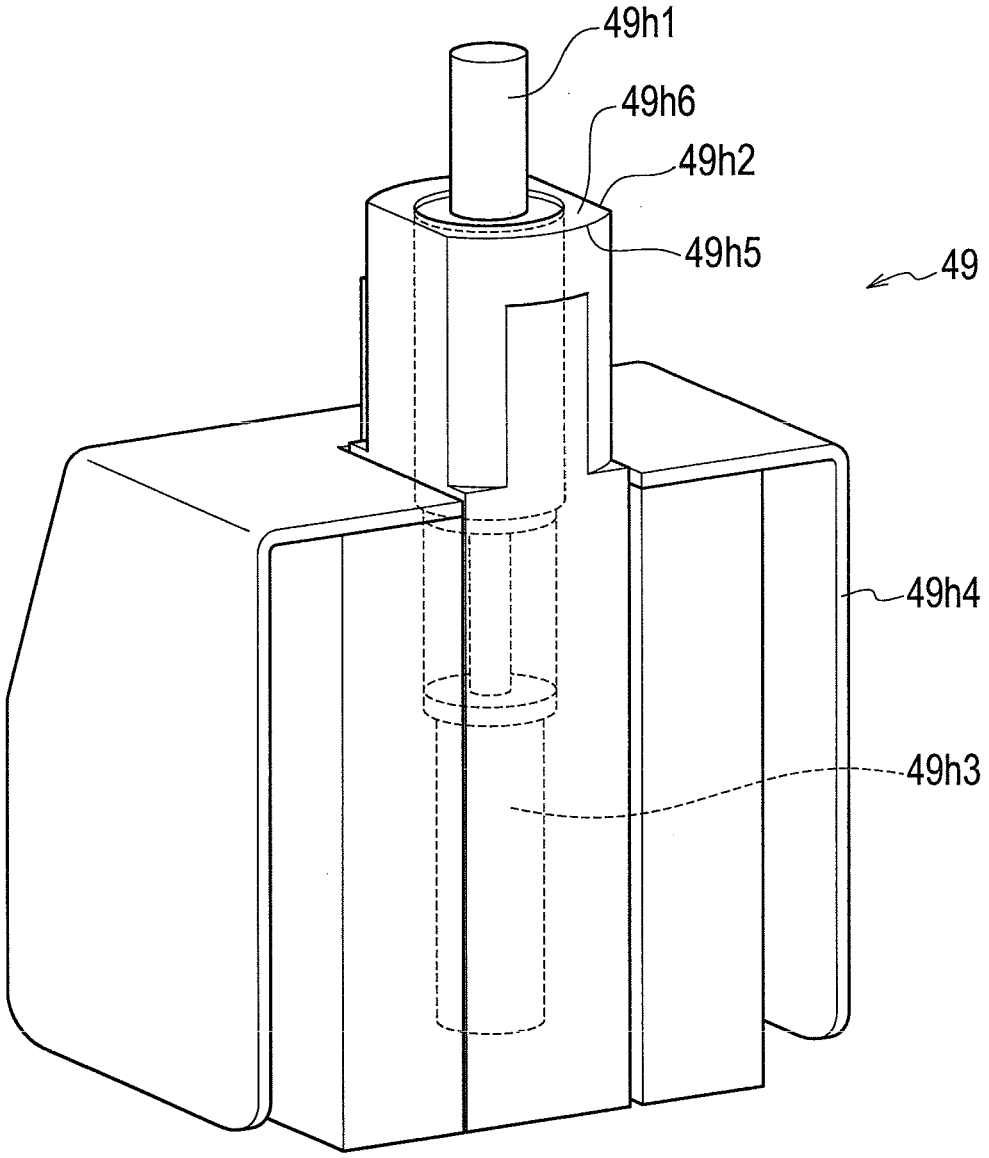
FIG. 13 It is a perspective view of the sensor head.

FIG. 13 shows only the sensor head 49*h* viewed along an arrow YS2 in FIG. 12. The sensor head 49*h* has a case 49*h*4, a guide 49*h*2, a contact element 49*h*1, and a linear scale 49*h*3. The guide 49*h*2 can be protruded from the case 49*h*4 in a vertical direction. The contact element 49*h*1 can be protruded from the guide 49*h*2 in a vertical direction. The liner scale 49*h*3 is housed in the case 49*h*4, and protrudes the contact element 49*h*1 and the guide 49*h*2 independently. Part of an end edge of the guide 49*h*2 is formed as a curved end ridge 49*h*5. In a state where the measurement portions 39F and 39R are installed on the press brake 1, protrusion directions of the guide 49*h*2 and the contact element 49*h*1 are a vertical direction.

When the sensor head 49*h* is protruded by the air cylinder 49*b*, the controller 93 controls the liner scale 49*h*3 to generate a pressing force enabling both of the end ridge 49*h*5 and the end of the contact element 49*h*1 to be contacted with a surface of a workpiece. The pressing force is set as a small force that doesn't affects bending of the workpiece. The contact element 49*h*1 is protruded until it is contacted with a surface of the workpiece. The guide 49*h*2 is also protruded until the end ridge 49*h*5 is contacted with a surface of the workpiece. The contact element 49*h*1 and the guide 49*h*2 can be protruded independently from each other, and their protrusion stroke amounts are measured by the liner scale 49*h*3 separately.

The liner scale 49*h*3 of the front measurement portion 39F measures each stroke amount of the contact element 49*h*1 and the guide 49*h*2, and then outputs the signal SG39F (see FIG. 3) to the controller 93 as the measurement result information. Similarly, the liner scale 49*h*3 of the rear measurement portion 39R measures each stroke amount of the contact element 49*h*1 and the guide 49*h*2, and then outputs the signal SG39R (see FIG. 3) to the controller 93 as the measurement result information.

Figure 14:
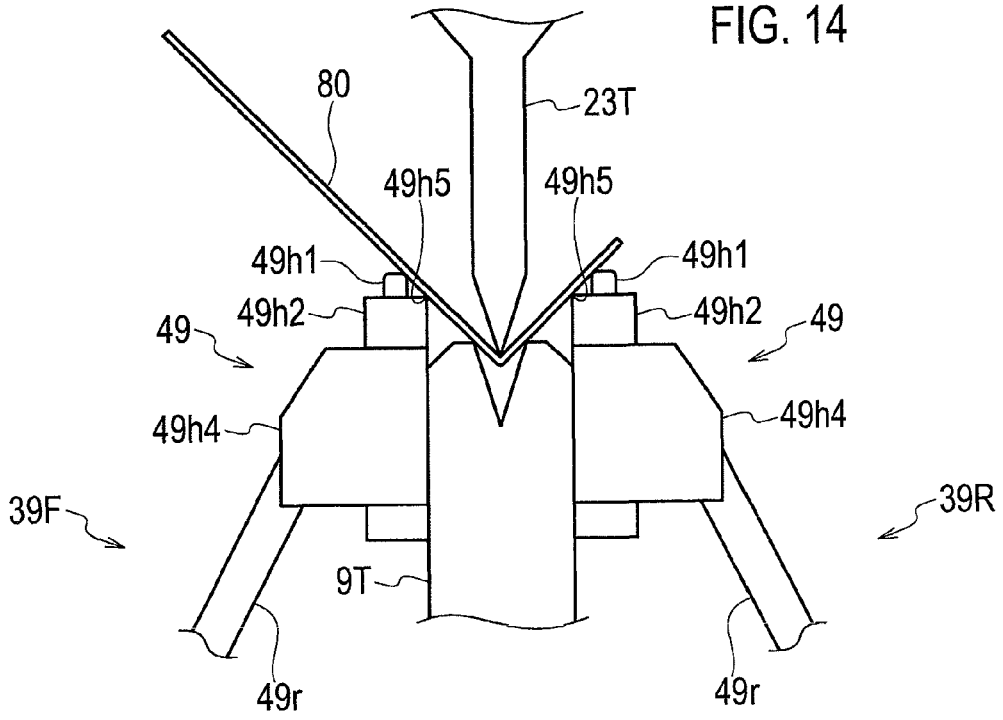
FIG. 14 It is a side view of the press brake (when measuring a work piece).
Figure 15:
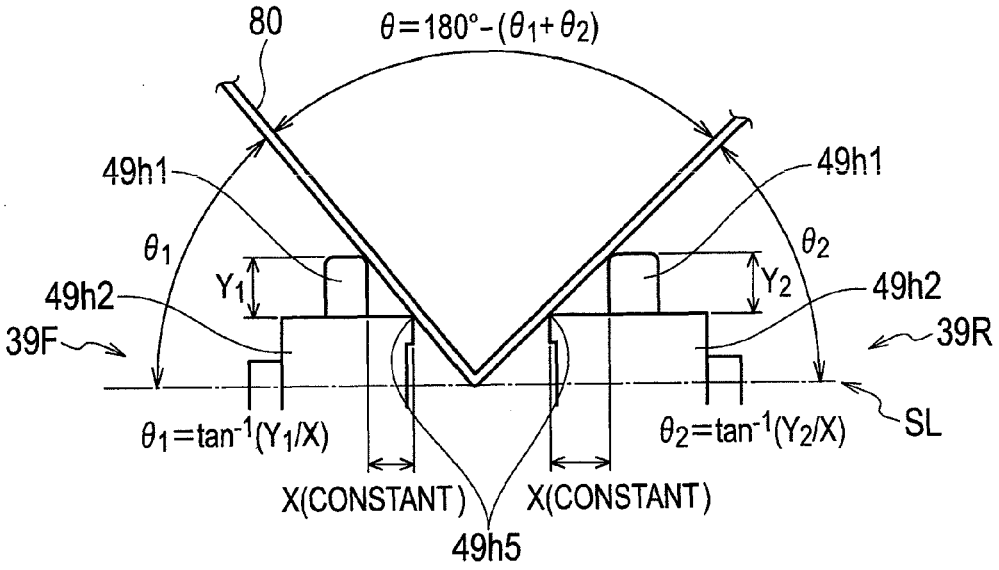
FIG. 15 It is a side view for explaining a method for calculating a bent angle of the work piece by the press brake.

As shown in FIG. 14, a workpiece 80 is bent by a downward movement of the punch 23T with its bottom surface supported by the die 9T. Before bending, the controller 93 extends the rods 49*r* of the measurement portions 39*f* and 39R by actuating the air cylinders 49*b* to contact the case 49*h*4 with a side face of the die 9T preliminarily. After a start of bending, the linear scale(s) 49*h*3 strokes the contact element 49*h*1 and the guide 49*h*2 upward in a vertical direction, and contacts them with the workpiece 80 and urges them toward the workpiece 80 to make them followed with shape changes of a bottom surface of the workpiece 80. During bending, the measurement portions 39F and 39R continuously output the signals SG39F and SG39R to the controller 93. The signals SG39F and SG39R include the measurement result information of a contact point between the contact element 49*h*1 of each of the measurement portions 39F and 39R and the workpiece 80 and a contact point between the guide 49*h*2 (the end ridge 49*h*5) and the workpiece 80.

The controller 93 calculates a bent angle of the workpiece 80 by using the measurement result information of total four points. As shown in FIG. 14, a distance from the end ridge 49*h*5 to an upper end edge of the contact element 49*h*1 on a side of the end ridge 49*h*5 is a constant value X. In addition, from the measurement result information, a protrusion amount $Y_1$ and $Y_2$ of the contact element 49*h*1 from a top face 49*h*6 of the guide 49*h*2 can be calculated from a difference between the stroke amount of the contact element 49*h*1 and the stroke amount of the guide 49*h*2. Front and rear oblique angles $\theta_1$[°] and $\theta_2$[°] of the workpiece 80 based on a horizontal line SL can be calculated from following equations.

$$\theta_1=\tan^{-1}(Y_1/X)$$

$$\theta_2=\tan^{-1}(Y_2/X)$$

Therefore, the bent angle θ[°] of the workpiece 80 can be calculated from a following equation.

$$\theta=180°-(\theta_1+\theta_2)$$

The controller 93 continuously monitors changes of the bent angle θ of the workpiece 80, and stops the ram 15 when a bent angle determined in consideration of springback and so on is achieved so that a bent angle of the workpiece 80 removed from the press brake 1 becomes a desired angle.

As explained above, in the press brake 1, a bent angle of the workpiece 80 is continuously measured by the measurement portions 39F and 39R, and operations of the ram 15 is controlled by the controller 93 based on the measurement results. Position information of the workpiece 80 to be measured by the measurement portions 39F and 39R, position information of the punch 23T on the punch station 23 and position information of the die 9T on the die station 9 are previously input into the controller 93 through the operation panel 92*b*. Note that, with respect to the position information of the punch 23T and the die 9T, the punch station 23 may automatically detect an installed position of the punch 23T and the die station 9 may automatically detect an installed position of the die 9T, and then the controller 93 may determine the positions based on the detection results. In addition, the main unit 39 of the measurement portions 39F and 39R is a part that carries out the measurements of a shape of the workpiece 80. The coupling portions 38FS and 38RS are not a part that carries out the measurements of a shape of the workpiece 80, but a part that has function of setting a position of the main unit 39.

In the press brake 1, the controller 93 moves the measurement portion 39R and the ATC device 40 so as not to contact the measurement portion 39R and the ATC device 40 with each other on the single guide rail 37R. Therefore, it becomes possible to make the measurement portion 39R and the ATC device 40 coexistent. In addition, in the press brake 1, the main units 39 of the measurement portions 39F and 39R can have an identical configuration by coupling the guide rails 37F and 37R with the main units 39 of the measurement portions 39F and 39R by the coupling portions 38FS and 38RS that have different shapes from each other, even when the guide rails 37F and 37R have different shapes from each other or even when the guide rails 37F and 37R are attached to the base 5 asymmetrically to each other. Therefore, the front measurement portion 39F and the rear measurement portion 39R can commonly use the main unit 39.

Note that it is desirable that the front measurement portion 39F and the rear measurement portion 39R measure the workpiece 80 at symmetrical positions with respect to the die 9T along all of a front-back direction, a lateral direction and a vertical direction. According to this, a shape of the workpiece 80 can be measured with high accuracy.

According to the present embodiment, it becomes possible to make the ATC device and the bend measurement device coexistent and make the front and rear measurement portions of the bend measurement device have an identical configuration.

The present invention(s) is not limited to the configurations and the processes according to the above embodiment, and can be modified within a scope that doesn't deviate from the subject matter of the present invention. For example, the measurement portions 39F and 39R may be supported by the guide rails 37F and 37R at plural positions, respectively. Note that the controller 93 controls positions of the plural measurement portions (39F and 39R) so as not to contact the plural measurement portions (39F and 39R) with each other. In addition, the plural measurement portions (39F and 39R) may measure a shape of the workpiece 80 with no contacts. Further, the controller 93 may not be included in the press brake 1. In this case, a communication unit is provided in the press brake 1 and the controller 93 is provided in an external device, and the controller 93 communicates with the communication unit by using wired or wireless connection to control the press brake 1.

The invention claimed is:

1. A press brake including an upper table to which a top tool is attachable and a lower table that is disposed oppositely to the upper table and to which a bottom tool is attachable within a predetermined lateral range to bend a workpiece by the top tool and the bottom tool, the press brake comprising:

a first guide rail extended laterally on one of a front side or a rear side of the lower table;

a second guide rail extended laterally on another of the front side or the rear side of the lower table;

an ATC device movably supported by the first guide rail to exchange the bottom tool;

a first measurement portion movably supported by the first guide rail to measure a dimension of one side of the workpiece; and a second measurement portion movably supported by the second guide rail to measure a dimension of another side of the workpiece, wherein the second guide rail has a different cross-sectional dimension from a cross-sectional dimension of the first guide rail, or is extended on the lower table at a bilaterally asymmetrical position to the first guide rail, the first measurement portion includes a first main unit having a sensor for measuring a dimension of the workpiece, and a first coupling portion for coupling the first main unit with the first guide rail, and the second measurement portion includes a second main unit having an identical configuration to a configuration of the first main unit, and a second coupling portion having a different dimension from a dimension of the first coupling portion for coupling the second main unit with the second guide rail.

2. The press brake according to claim 1, further comprising a first waiting area that is provided in one of areas outside the predetermined lateral range and into which the first measurement portion is moved while the ATC device exchanges the bottom tool, and a second waiting area that is provided in another of areas outside the predetermined lateral range and into which the ATC device is moved while the first measurement portion measures the workpiece.

3. The press brake according to claim 2, wherein each of the first main unit and the second main unit includes, as part of the identical configuration, a sensor head at whose end the sensor is provided, and an air cylinder for moving the sensor head obliquely upward toward the bottom tool at measurement.

4. The press brake according to claim 3, wherein the sensor has a contact element and a guide to be contacted with a surface of the workpiece, and a liner scale that can detect stroke amounts of the contact element and the guide independently, and the press brake further comprises a controller that calculates a bent angle of the workpiece based on the stroke amounts of the contact element and the guide with respect to the first measurement portion and the stroke amounts of the contact element and the guide with respect to the second measurement portion.

5. The press brake according to claim 4, wherein the controller is configured to control also the air cylinder, and controls the air cylinder so as to contact the sensor heads of the first measurement portion and the second measurement portion with side faces of the bottom tool, respectively, at measurement.

6. A bending method for the workpiece using the press brake according to claim 2, wherein the press brake further comprises a controller that controls movements and operations of the first measurement portion and the ATC device on the first guide rail, the method comprising:

controlling the first measurement portion by the controller to move the first measurement portion into the first waiting area;

controlling the ATC device by the controller to install a bottom tool on the lower table within the predetermined lateral range;

controlling the ATC device by the controller to move the ATC device into the second waiting area; and controlling the first measurement portion by the controller to measure a shape of the workpiece bent by the installed bottom tool by using the first measurement portion.

* * * * *